US009739520B2

(12) United States Patent
Miller et al.

(10) Patent No.: US 9,739,520 B2
(45) Date of Patent: Aug. 22, 2017

(54) COMBINED IMPINGEMENT/PLATE FREEZER

(71) Applicant: John Bean Technologies Corporation, Chicago, IL (US)

(72) Inventors: Michael E. Miller, Hattieville, AR (US); Darin L. Chancellor, Danville, AR (US)

(73) Assignee: John Bean Technologies Corporation, Chicago, IL (US)

( * ) Notice: Subject to any disclaimer, the term of this patent is extended or adjusted under 35 U.S.C. 154(b) by 158 days.

(21) Appl. No.: 14/356,961

(22) PCT Filed: Oct. 8, 2012

(86) PCT No.: PCT/US2012/059201
§ 371 (c)(1),
(2) Date: May 8, 2014

(87) PCT Pub. No.: WO2013/070359
PCT Pub. Date: May 16, 2013

(65) Prior Publication Data

US 2014/0298851 A1 Oct. 9, 2014

Related U.S. Application Data

(60) Provisional application No. 61/628,984, filed on Nov. 10, 2011.

(51) Int. Cl.
*F25D 17/06* (2006.01)
*F25D 13/06* (2006.01)

(52) U.S. Cl.
CPC ..... *F25D 17/06* (2013.01); *F25D 13/06* (2013.01); *F25D 13/062* (2013.01)

(58) Field of Classification Search
CPC . F25D 3/127; F25D 25/07; F25D 3/11; F25D 25/04; A23L 3/361
See application file for complete search history.

(56) References Cited

U.S. PATENT DOCUMENTS 4,171,625 A * 10/1979 Morgan ..... A23L 3/361 62/216
4,555,914 A * 12/1985 Kanto ..... A23L 3/361 198/626.6

(Continued)

OTHER PUBLICATIONS

International Search Report and Written Opinion, PCT/US2012/59201 (Jan. 4, 2013).

(Continued)

*Primary Examiner* — Cassey D Bauer
(74) *Attorney, Agent, or Firm* — Christensen O'Connor Johnson Kindness PLLC

(57) ABSTRACT

A contact freezer (10) combining the techniques of plate freezing and impingement freezing. One or more cooling modules (11) are disposed sequentially with a continuous conveyor (14) for carrying a food product. Each cooling module (11) includes a refrigerated plate (16) disposed underneath and supporting the conveyor (14). The food product is simultaneously cooled using the impingement freezing technique. A cooling coil (19) is disposed above the conveyor (14). One or more fans (22) disposed below the cooling coil (19) circulate air downwardly through the cooling coil (19) and through an array of diverters (23) so that high speed cooled air is directed onto the food product. The contact freezer (10) may also include a pre-chilling section (12) with a refrigerated plate (24) but without impingement freezing elements.

7 Claims, 4 Drawing Sheets

(56) References Cited

U.S. PATENT DOCUMENTS

| | | | | |
|---|---|---|---|---|
| 4,760,712 | A | 8/1988 | Hashimoto | |
| 5,131,241 | A | 7/1992 | Battistella | |
| 5,156,008 | A * | 10/1992 | Olsson | A23G 9/18 62/378 |
| 5,444,985 | A | 8/1995 | Lang et al. | |
| 5,509,277 | A | 4/1996 | Kiczek | |
| 5,551,251 | A | 9/1996 | Ochs | |
| 6,009,719 | A * | 1/2000 | Ochs | A23L 3/361 62/380 |
| 6,298,686 | B1 | 10/2001 | Moore | |
| 6,434,950 | B2 | 8/2002 | Newman | |
| 6,557,367 | B1 | 5/2003 | Lang et al. | |
| 6,640,576 | B2 | 11/2003 | Berghoff et al. | |
| 6,796,142 | B2 | 9/2004 | Burn | |
| 7,823,409 | B2 | 11/2010 | Colding-Kristensen | |
| 2005/0092014 | A1 * | 5/2005 | Nothum, Jr. | A23L 3/361 62/380 |
| 2008/0163640 | A1 | 7/2008 | Petersen | |

OTHER PUBLICATIONS

Patent Examination Report No. 2, Australian Patent Application No. 2012336238 (Aug. 6, 2015).
Patent Examination Report No. 1, Australian Patent Application No. 2012336238 (Apr. 1, 2015).
Office Action, Canadian Patent Application No. 2,854,737 (May 11, 2015).
Canadian Patent No. 2,854,737 (Mar. 29, 2016).
Further Examination Report, New Zealand Application No. 624718 (Jun. 30, 2015).
First Examination Report, New Zealand Application No. 624718 (Dec. 5, 2014).

* cited by examiner

FIG. 4A
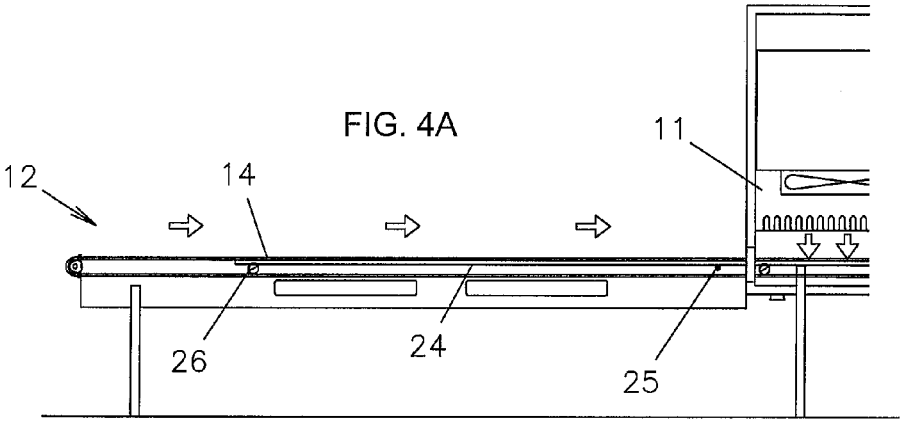
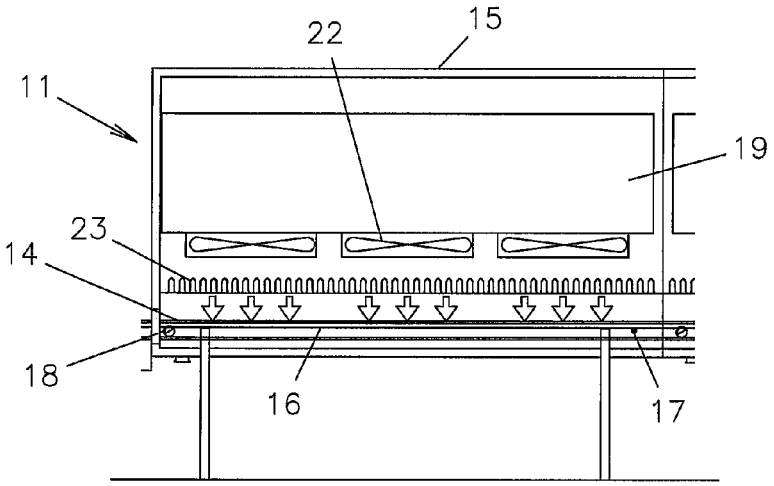
FIG. 4B
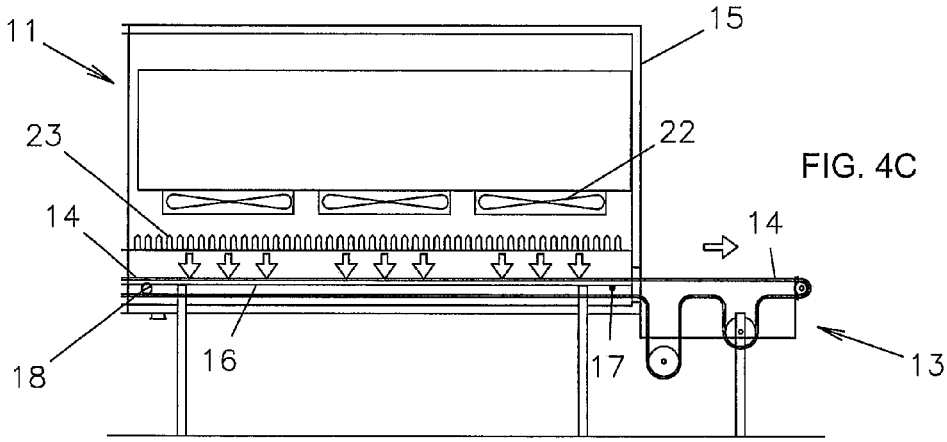
FIG. 4C

COMBINED IMPINGEMENT/PLATE FREEZER

This application claims the benefit of U.S. Provisional Patent Application No. 61/628,984 filed Nov. 10, 2011, which is incorporated herein by reference in its entirety.

TECHNICAL FIELD

The present invention relates to the freezing of food products, and in particular, to a freezer that combines the techniques of plate freezing and impingement freezing.

BACKGROUND ART

Impingement freezers are well known in the art. Impingement freezers quickly freeze products by impinging refrigerated air onto the product which may be carried through the freezer on a conveyor belt. The impinged air may be directed onto the product by nozzles or by plates with perforations or channels for directing the air onto the product from above or below the product or both.

Plate freezers are also well known in the art. Plate freezers are typically used to freeze flat products or products packaged into flat packages or containers.

In some applications, both impingement freezers and plate freezers are employed which requires the dedication of valuable factory floor space for each separate freezer. It would be desirable to provide for both types of freezing in the same device to minimize the use of factory floor space.

The limitations of the prior art are overcome by the present invention as described below.

DISCLOSURE OF THE INVENTION

The present invention is directed to a device combining the techniques of plate freezing and impingement freezing. The device comprises one or more cooling modules disposed sequentially to obtain the degree of cooling required for a given application.

Each module comprises an enclosed insulated box. A continuous conveyor for carrying a food product runs through the sequence of insulated boxes. Each insulated box includes a refrigerated plate disposed underneath and supporting the conveyor. The refrigerated plate comprises an enclosed box through which a refrigerant, such as ammonia, runs. Each enclosed box is made of a suitable heat transfer material and is provided with a refrigerant inlet port and a refrigerant suction port. The inlet port and the suction port are operatively to connected to refrigeration equipment for refrigerating the refrigerant as known in the art.

The food product is simultaneously cooled using the impingement freezing technique. A cooling coil carrying a refrigerant is disposed within each insulated box above the conveyor. Each cooling coil is provided with a refrigerant inlet port and a refrigerant suction port. The inlet port and the suction port are operatively to connected to refrigeration equipment for refrigerating the refrigerant as known in the art. One or more fans are disposed below the cooling coil. Air within the insulated box is circulated downwardly through the cooling coil by the fans so that the air is cooled by the refrigerant.

An array of diverters is disposed below the fans so that the cooled air is forced to speed up in passing through the diverters. The high speed cooled air is then directed onto the food product disposed on the top of the conveyor using the impingement freezing technique.

The contact freezer may also comprise a pre-chilling section including the conveyor and refrigerated plate without the impingement freezing elements described above. The pre-chilling section is disposed in front of the first of the plurality of cooling modules. The pre-chilling section is not disposed within an insulated box. The food product is placed on the pre-chilling section where the cooling process is initiated and the food product is pre-chilled by the refrigerated plates disposed below the conveyor. The pre-chilled food product is then introduced to the cooling modules for freezing using both the plate freezing technique in combination with the impingement freezing technique.

BRIEF DESCRIPTION OF THE DRAWINGS

These and other features, objects and advantages of the present invention will become better understood from a consideration of the following detailed description, appended claims and accompanying drawings where:

FIG. 4A is a partial left side elevation view of the embodiment of the contact freezer of FIG. 3 showing the pre-chilling section in detail.

FIG. 4B is a partial left side elevation view of the embodiment of the contact freezer of FIG. 3 showing the cooling module following the pre-chilling section in detail.

FIG. 4C is a partial left side elevation view of the embodiment of FIG. 3 showing the cooling module preceding the exit section in detail.

BEST MODE FOR CARRYING OUT THE INVENTION

Figure 1:
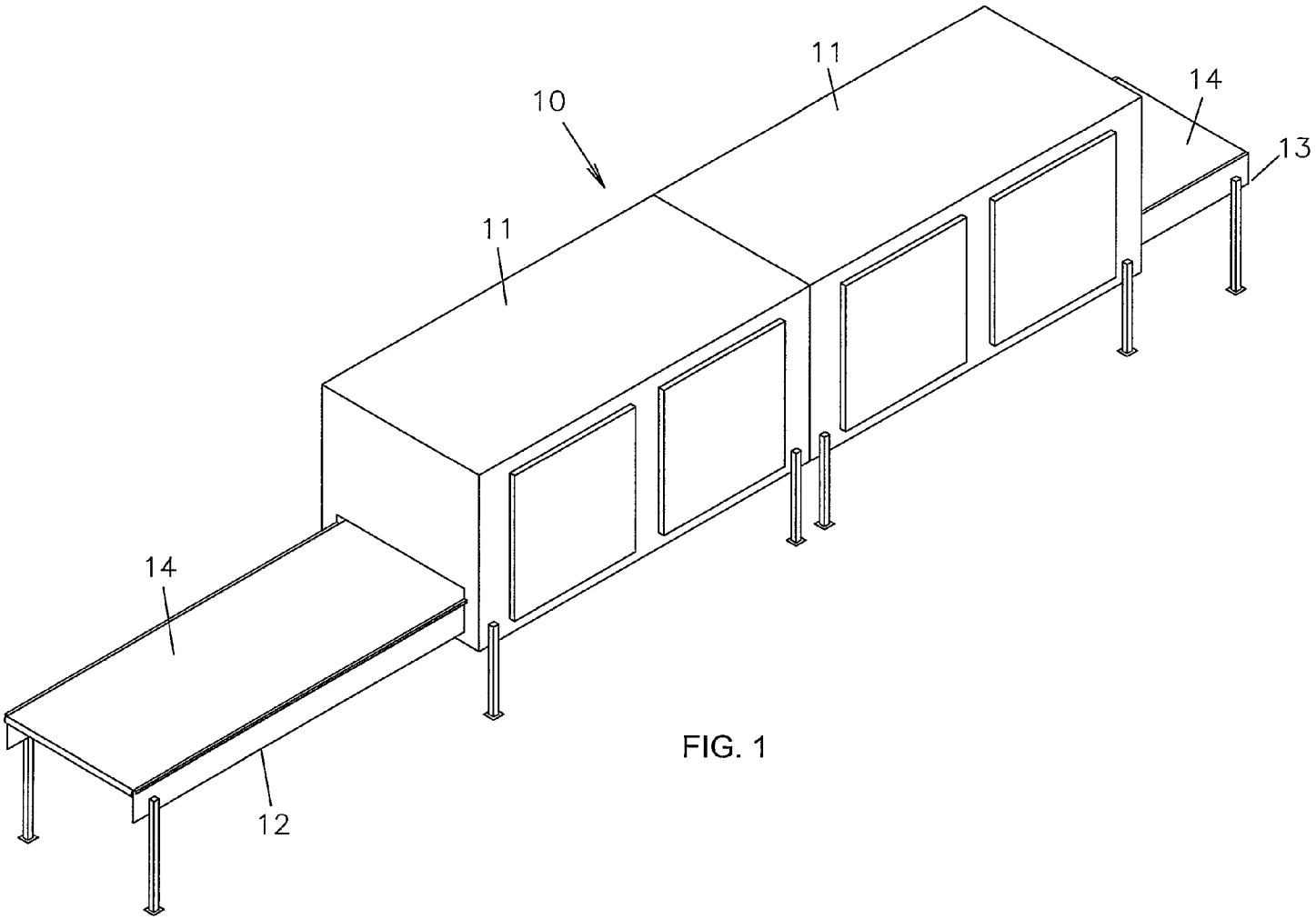
FIG. 1 is a left front perspective view of an embodiment of the contact freezer of the present invention showing in sequence a pre-chilling section, a cooling module, another cooling module and an exit section.
Figure 2:
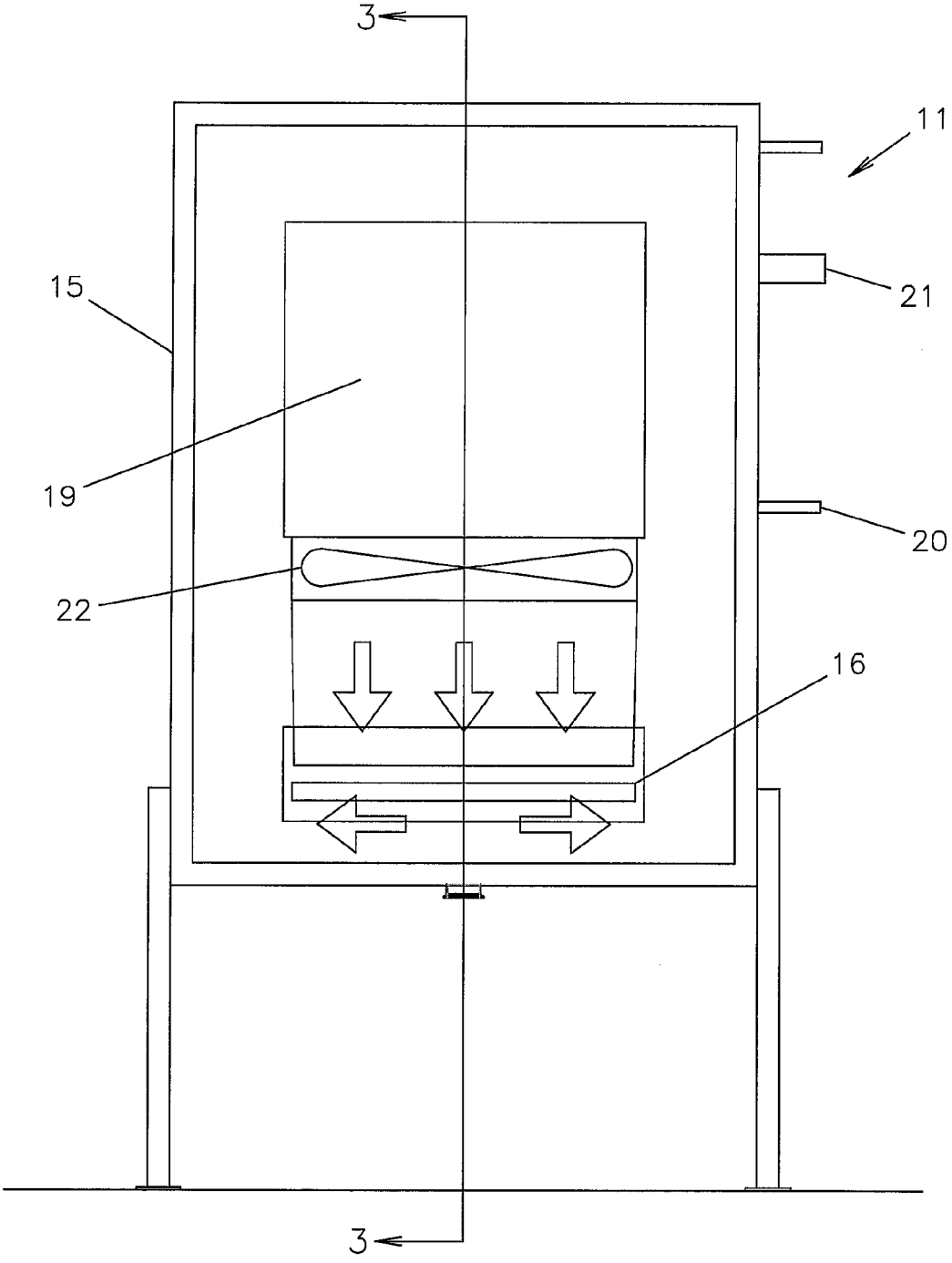
FIG. 2 is a cross sectional front elevation view of a cooling module of the embodiment of FIG. 1 taken along the line 2-2 of FIG. 3.
Figure 3:
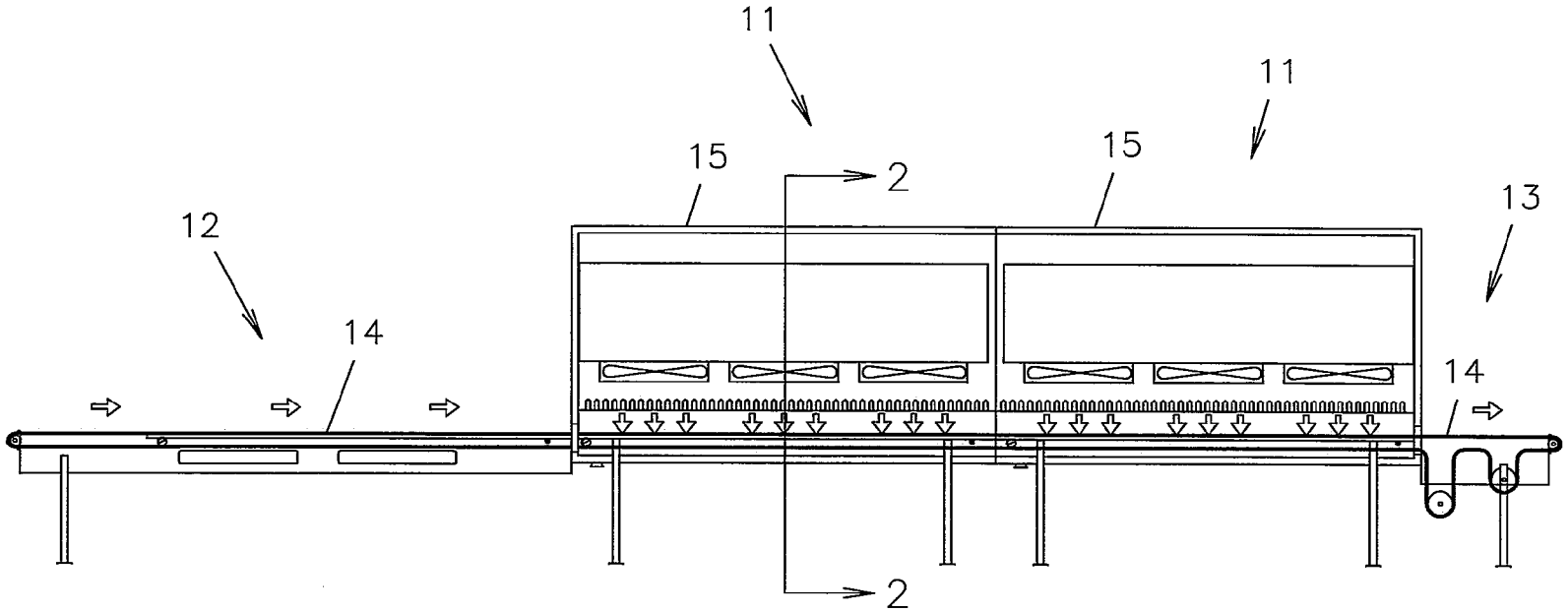
FIG. 3 is left side elevation view of the embodiment of FIG. 1 taken along the line 3-3 of FIG. 2.

With reference to FIGS. 1-4C, the preferred embodiment of the present invention may be described as follows:

FIGS. 1 and 3 illustrate an embodiment of a contact freezer 10 of the present invention. The contact freezer 10 combines the techniques of plate freezing and impingement freezing of a food product in a single device. The contact freezer 10 comprises one or more cooling modules 11 disposed sequentially to obtain the degree of cooling required for a given application. Each cooling module 11 may be approximately ten (10) feet in length so that by combining a plurality of cooling modules 11 in sequence, any length can be achieved as required for the degree of cooling appropriate for a given application.

Each contact freezer 10 may also include a pre-chilling section 12 located prior to any of the plurality of cooling modules 11 and an exit section 13 located subsequent to the last of the plurality of chilling modules 11. A continuous conveyor 14 runs along the length of the pre-chilling section 12, the plurality of cooling modules 11 and the exit section 13. Food products are placed on the pre-chilling section 12, pass through the plurality of cooling modules 11 and removed from the exit section 14. The conveyor 14 may be constructed and operated as would be well known in the art. For example, the conveyor 14 may be disposed on and around a series of rollers and may be driven by an electric drive motor.

As shown in FIGS. 2, 3 and 4A-4C, each cooling module 11 comprises an enclosed insulated box 15. The continuous conveyor 14 for carrying a food product runs through the sequence of insulated boxes 15 through openings provided in the inlet and outlet ends of each insulated box 15. Each insulated box 15 includes a refrigerated plate 16 disposed underneath and supporting the conveyor 14. Each refrigerated plate 16 comprises an enclosed box through which a refrigerant, such as ammonia, runs. Each refrigerated plate 16 is made of a suitable heat transfer material and is provided with a refrigerant inlet port 17 and a refrigerant suction port 18. The inlet port 17 and the suction port 18 are operatively connected to refrigeration equipment (not shown) for refrigerating the refrigerant as known in the art.

The food product transported through the cooling modules 11 is simultaneously cooled using both the plate freezing technique as described above and the impingement freezing technique. A cooling coil 19 carrying a refrigerant is disposed within each cooling module 11 above the conveyor 14. Each cooling coil 19 is provided with a refrigerant inlet port 20 and a refrigerant suction port 21. The inlet port 20 and the suction port 21 are operatively connected to refrigeration equipment (not shown) for refrigerating the refrigerant as known in the art. One or more fans 22 are disposed below the cooling coil 19. Air within the cooling module 11 is circulated downwardly through the cooling coil 19 by the fans 22 so that the air is cooled by the refrigerant.

An array of diverters 23 is disposed below the fans 22. The diverters define a plurality of narrow channels for passage of the air so that the cooled air is forced to speed up in passing through the array of diverters 23. The high speed cooled air is then directed onto the food product disposed on the top of the conveyor 14 so that the food product is cooled using the impingement freezing technique.

As shown in FIGS. 1, 3 and 4A, the pre-chilling section 12 includes the conveyor 14 supported on a refrigerated plate 24 without the impingement freezing elements described above for the cooling module 11. The pre-chilling section 12 is disposed in front of the first of the plurality of cooling modules 11. The pre-chilling section 12 is not disposed within an insulated box. The food product is placed on conveyor 14 within the pre-chilling section 12 where the cooling process is initiated and the food product is pre-chilled by the refrigerated plate 24 disposed below the conveyor 14. The refrigerated plate 24 is an enclosed box made of a suitable heat transfer material. A refrigerant, such as ammonia, is circulated within the enclosed box of the refrigerated plate 24. The refrigerated plate 24 is provided with a refrigerant inlet port 25 and a refrigerant suction port 26. The inlet port 25 and the suction port 26 are operatively to connected to refrigeration equipment (not shown) for refrigerating the refrigerant as known in the art.

After pre-chilling on the pre-chill section 12, the pre-chilled food product is then introduced to the cooling modules 11 for freezing using both the plate freezing technique in combination with the impingement freezing technique as described above.

INDUSTRIAL APPLICABILITY

The present invention combines the techniques of plate freezing and impingement freezing. One or more cooling modules disposed sequentially obtain the degree of cooling required for a given application. A continuous conveyor carries a food product through the sequence of cooling modules having a refrigerated plate disposed underneath and supporting the conveyor. The food product is simultaneously cooled using the impingement freezing technique in which high speed cooled air is directed onto the food product.

The present invention has been described with reference to certain preferred and alternative embodiments that are intended to be exemplary only and not limiting to the full scope of the present invention as set forth in the appended claims.

The invention claimed is:

1. A combined impingement/plate freezer system for cooling a food product, comprising:

(a) a pre-chiller section comprising a first refrigerated plate section;

(b) at least one cooling module disposed downstream of the pre-chiller section, the cooling module comprising:

an insulated box having an inlet opening and an outlet opening, a second refrigerated plate disposed within the insulated box, a conveyor disposed at least partly within the insulated box for carrying the food product though the inlet opening, the insulated box and the outlet opening, the conveyor comprising a belt passing over and supported by the underlying first refrigerated plate of the pre-chiller section passing over and supported by the underlying second refrigerated plate of the at least one cooling module;

a cooling coil disposed within the insulated box above the conveyor, a fan positioned for circulating air downwardly through the cooling coil and towards the conveyor for impinging the air onto the food product disposed on the conveyor.

2. The combined impingement/plate freezer system of claim 1, comprising a plurality of the cooling modules disposed for moving the food product sequentially though said cooling modules and further wherein the conveyor is a continuous conveyor disposed through the plurality of the cooling modules.

3. The combined impingement/plate freezer system of claim 1, further comprising an exit section disposed following a last in sequence of the plurality of the cooling modules, the conveyor conveying the thermally treated food product along the exit section.

4. The combined impingement/plate freezer system of claim 1, further comprising an array of diverters disposed below the fan for increasing the speed of the air circulated by the fan.

5. The combined impingement/plate freezer system of claim 4, wherein the array of diverters comprises a plurality of channels for passage of the air circulated by the fan.

6. A method of cooking a food product while being carried on a conveyor, comprising:

moving the food products along a pre-chiller section on a conveyor belt supported by a first refrigerated plate to cool the underside of the food product;

moving the food product on the conveyor through an insulated box of a cooling module, the insulated box having an inlet opening and an outlet opening;

subjecting the food product to thermal treatment within the insulated box from a second refrigerated plate disposed beneath and supporting the conveyor, and from air circulated downwardly through a cooling coil and towards the conveyor, whereby the food product is simultaneously cooled by the second refrigerated plate and the air circulated through the cooling coil as the food product travels through the insulated box; and moving the food product on the conveyor through the outlet opening of the insulated box.

7. The method of claim 6, further comprising moving the food product through a plurality of cooling modules on the conveyor.

* * * * *